US006964636B2

(12) United States Patent
Verheem et al.

(10) Patent No.: US 6,964,636 B2
(45) Date of Patent: Nov. 15, 2005

(54) EXERCISE DEVICE

(75) Inventors: Johann B. Verheem, Carlsbad, CA (US); James A. Jernigan, Houston, TX (US); Stephen G. Hauser, Tarzana, CA (US)

(73) Assignee: ResponseIQ, LLC, Carlsbad, CA (US)

( * ) Notice: Subject to any disclaimer, the term of this patent is extended or adjusted under 35 U.S.C. 154(b) by 0 days.

(21) Appl. No.: 10/318,980

(22) Filed: Dec. 12, 2002

(65) Prior Publication Data

US 2003/0162638 A1 Aug. 28, 2003

Related U.S. Application Data

(60) Provisional application No. 60/358,537, filed on Feb. 22, 2002.

(51) Int. Cl.[7] ..... A63B 21/00
(52) U.S. Cl. ..... 482/121; 482/130; 482/142
(58) Field of Search ..... 482/130, 142, 482/123, 121, 129, 126, 140, 148

(56) References Cited

U.S. PATENT DOCUMENTS 4,358,109 A * 11/1982 Schrems
D350,450 S 9/1994 Hassel et al. ..... D6/349
5,352,176 A 10/1994 Huang ..... 482/146
D353,419 S 12/1994 Sprague ..... D21/191
D355,458 S 2/1995 Chen ..... D21/171
D362,479 S 9/1995 Destasio, Jr. ..... D21/193
5,542,674 A * 8/1996 Kim ..... 473/218
D380,508 S 7/1997 Chang ..... D21/193
D382,125 S 8/1997 Chuang ..... D6/353
5,759,139 A * 6/1998 Wright
5,954,622 A * 9/1999 Olschansky et al.
6,030,323 A * 2/2000 Fontenot et al.
6,248,047 B1 * 6/2001 Abdo
6,402,667 B1 * 6/2002 Dahn
6,402,669 B1 * 6/2002 Olstad ..... 482/123
6,406,410 B1 * 6/2002 Lochbaum
D460,506 S 7/2002 Tamminga et al. ..... D21/686
6,547,705 B2 * 4/2003 Yu
6,726,607 B1 * 4/2004 Ihli ..... 482/127

* cited by examiner

*Primary Examiner*—Jerome W. Donnelly
(74) *Attorney, Agent, or Firm*—Townsend and Townsend and Crew

(57) ABSTRACT

Disclosed is an exercise device that includes a base that has at least one receptacle and further includes a resistance member that is adapted to rest in the at least one receptacle. The base may include a plurality of receptacles so as to provide a number of positions that the resistance member may rest in so as to allow the user to perform a variety of exercises and motions with the exercise device. The resistance member may be adjustable to provide more than one level of resistance.

8 Claims, 16 Drawing Sheets

102

EXERCISE DEVICE

This application is a utility patent application that claims the benefit of U.S. Provisional Application Ser. No. 60/358537 filed on Feb. 22, 2002, entitled ABDOMINAL CHAIR EXERCISER, and relates to Taiwanese Patent Application P0910620, filed on Jul. 11, 2002, which are hereby fully incorporated herein as though set forth in full.

FIELD OF THE DISCLOSURE

The present invention relates to an exercising device and, more particularly, an exercise device with a variable resistance mechanism which allows the user to regulate the level of physical activity, and the device provides several exercises for the user.

BACKGROUND OF THE DISCLOSURE

Exercise devices that provide a variety of exercises and physical movements for a user with variable resistance loads are typically large, expensive machines that are purchased by athletic club facilities for the enjoyment of those that have the resources to join an athletic club. Unfortunately, the cost associated with joining an athletic club, as well as the inconvenience of users having to travel to an athletic club to exercise exclude a number of potential users. In addition, many potential users do not have access to athletic club because of their rural location or because daily demands simply do not allow them to take enough time in the day to travel to an athletic club to exercise. For those potential users who have the financial means to purchase exercise devices for their home, many are limited by space constraints in their homes. Therefore, many people do not exercise because their homes cannot house a large exercise device or because of the costs and inconvenience associated with joining an athletic club.

SUMMARY OF THE DISCLOSURE

Disclosed is an exercise device that includes a base that has at least one receptacle and further includes a resistance member that is adapted to rest in the at least one receptacle. The base may include a plurality of receptacles so as to provide a number of positions that the resistance member may rest in so as to allow the user to perform a variety of exercises and motions with the exercise device. The resistance member may be adjustable to provide more than one level of resistance.

In another embodiment, disclosed is a body exercising device that includes a sleeve having a top end protruded with an upright tube, the upright tube provided with a handle mounting structure for mounting a handle, a retractable sleeve secured on the bottom end of the sleeve, an insertion sleeve secured on the bottom end of the retractable sleeve and inserted into the insertion holes of a seat cushion, the sleeve having a mediate section having an outer wall formed with two opposite rotation slots for mounting a drive structure; the drive structure including two opposite rotation blocks respectively mounted on the sleeve, a passage rod mounted between the two opposite rotation blocks and extended through the two opposite rotation slots of the sleeve, a guide rod having a top end mounted on the passage rod, a first spring mounted on the guide rod, the guide rod having a bottom end provided with a protruding drive shaft for driving a first race and a second race; an outer tube mounted in the sleeve for passage of the guide rod, the top end of the outer tube urged on the bottom end of the first spring, the first race mounted in the outer tube and having an inner wall provided with two protruding blocks for pressing of the drive shaft of the guide rod, the second race mounted in the outer tube and having an inner wall provided with two protruding blocks for pressing of the drive shaft of the guide rod, the first race having an outer wall provided with a guide block that may slide on a middle tube, and the second race having an outer wall provided with a guide block that may slide on the middle tube; an inner tube having a top end secured on the bottom end of the guide rod, a second spring mounted on the inner tube and urged between the second race and the insertion sleeve; the middle tube mounted between the second spring of the inner tube and the outer tube and having an outer wall provided with two opposite guide grooves for guiding movement of the guide block of the first race and the guide block of the second race, a third spring mounted on the middle tube and urged between the first race and the insertion sleeve; wherein, the sleeve may be used to compress the first spring, while the rotation blocks of the drive structure may be rotated to rotate the drive shaft of the guide rod, so that the drive shaft of the guide rod may be inserted into the first race or the second race, thereby increasing the pushing and supporting force of the second spring and the third spring, and thereby changing the exercising load, so as to achieve the requirements of different users.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE DISCLOSURE

Figure 1:
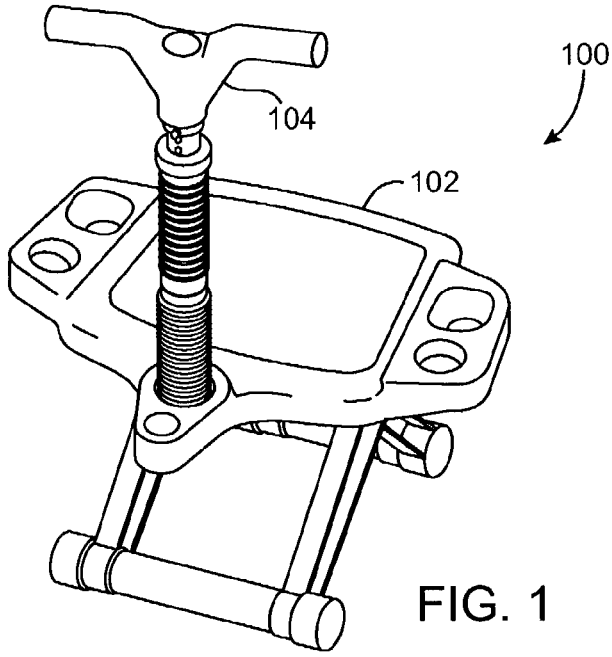
FIG. 1 is a front perspective view of an exercise device according to the present disclosure.
Figure 2:
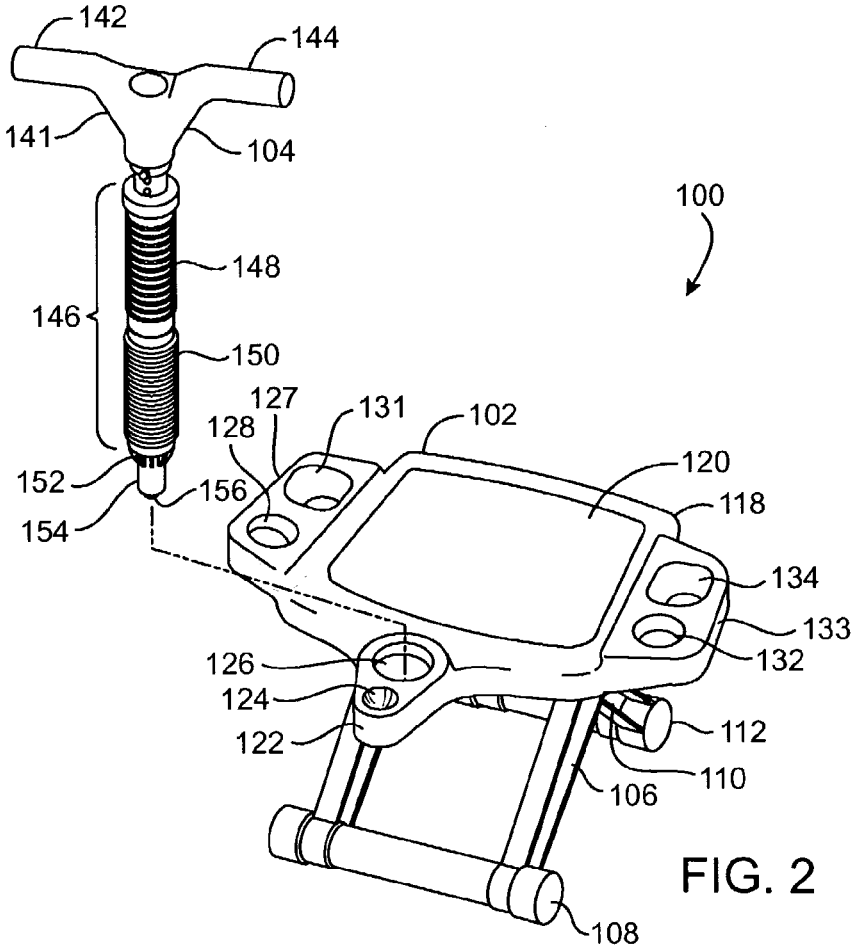
FIG. 2 is an exploded front perspective view of the exercise device showing a handle portion separated from a seat portion.
Figure 3:
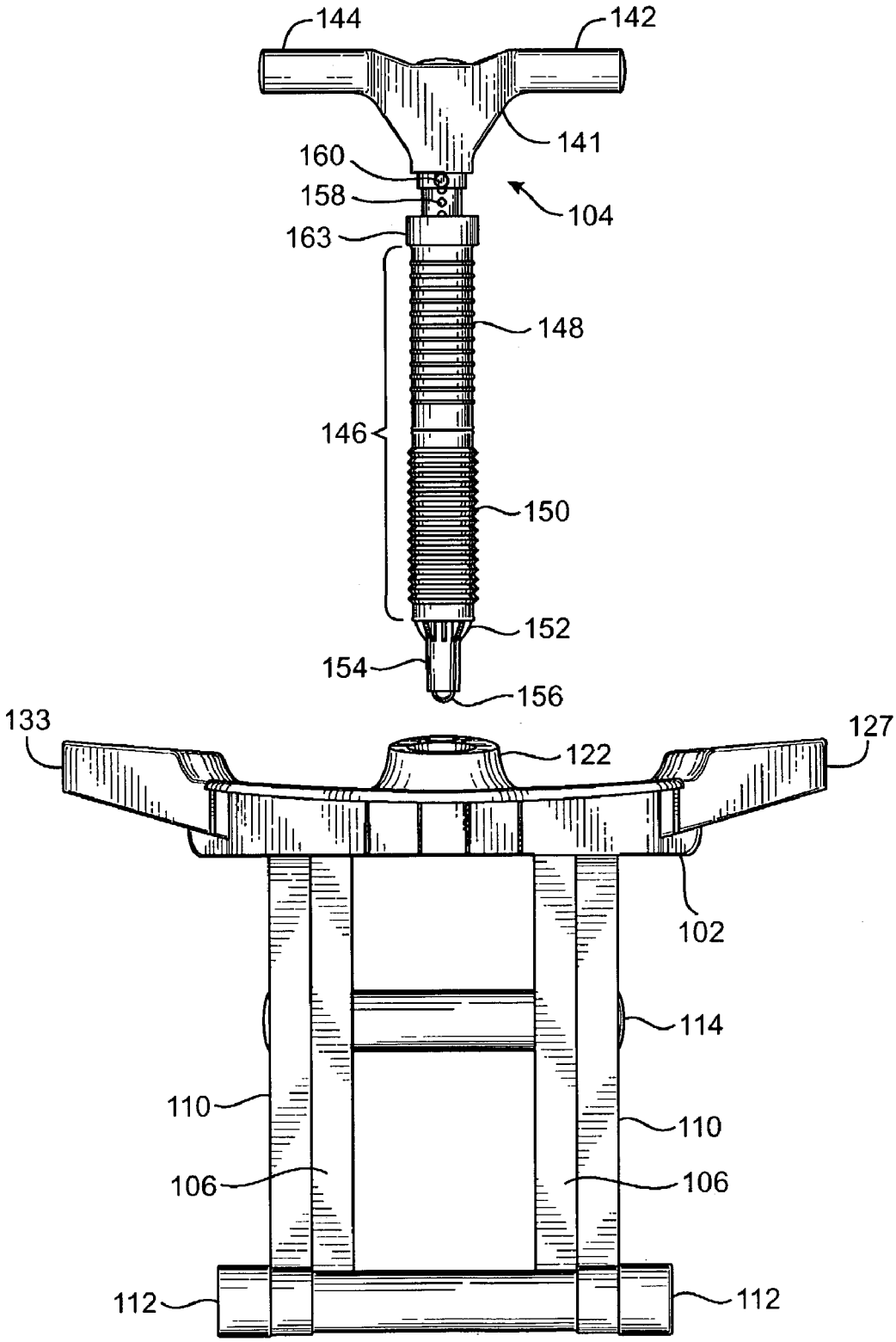
FIG. 3 is an exploded rear elevational view of the exercise device.
Figure 4:
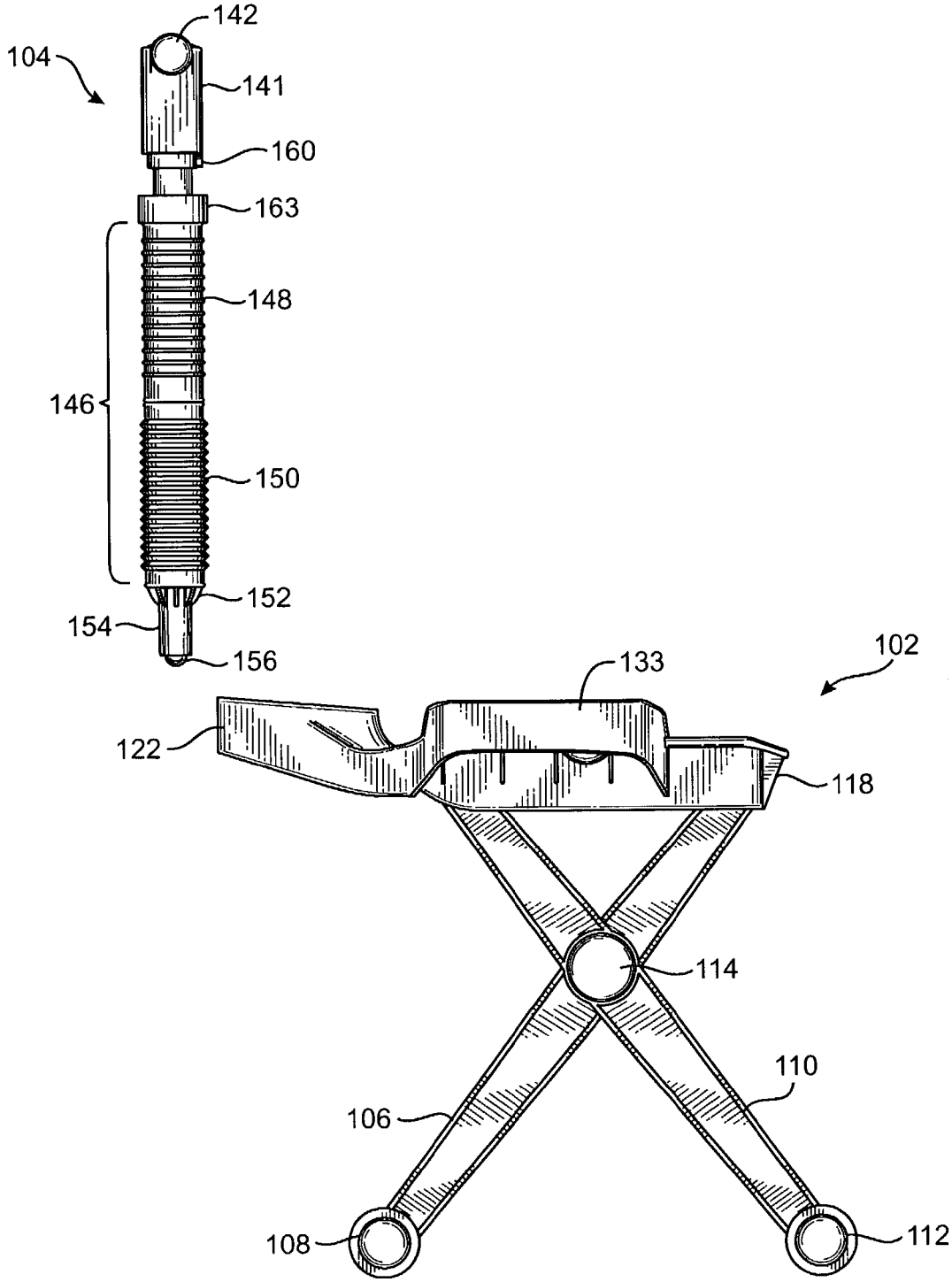
FIG. 4 is an exploded left side elevational view of the exercise device.
Figure 5:
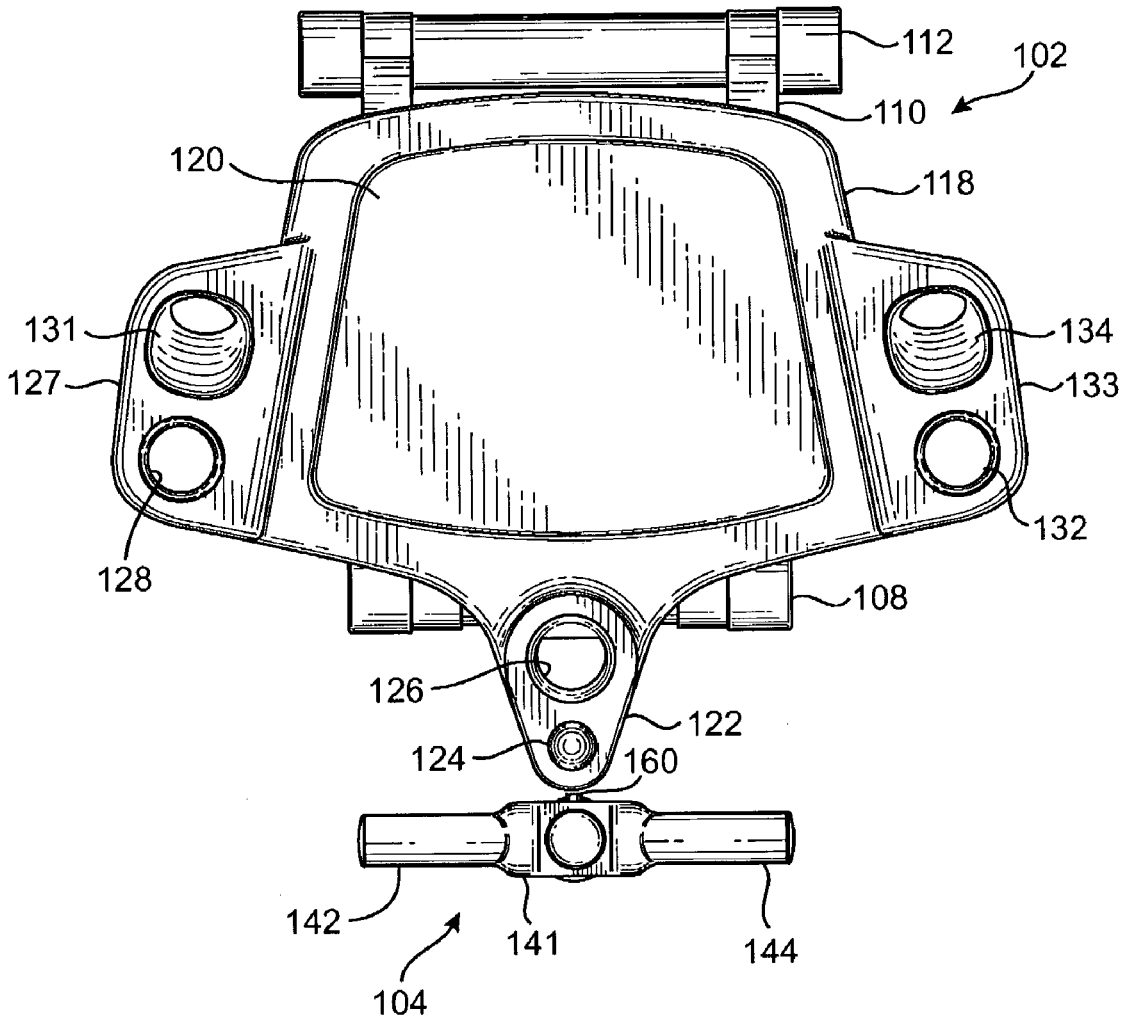
FIG. 5 is an exploded top plan view of the exercise device.
Figure 6:
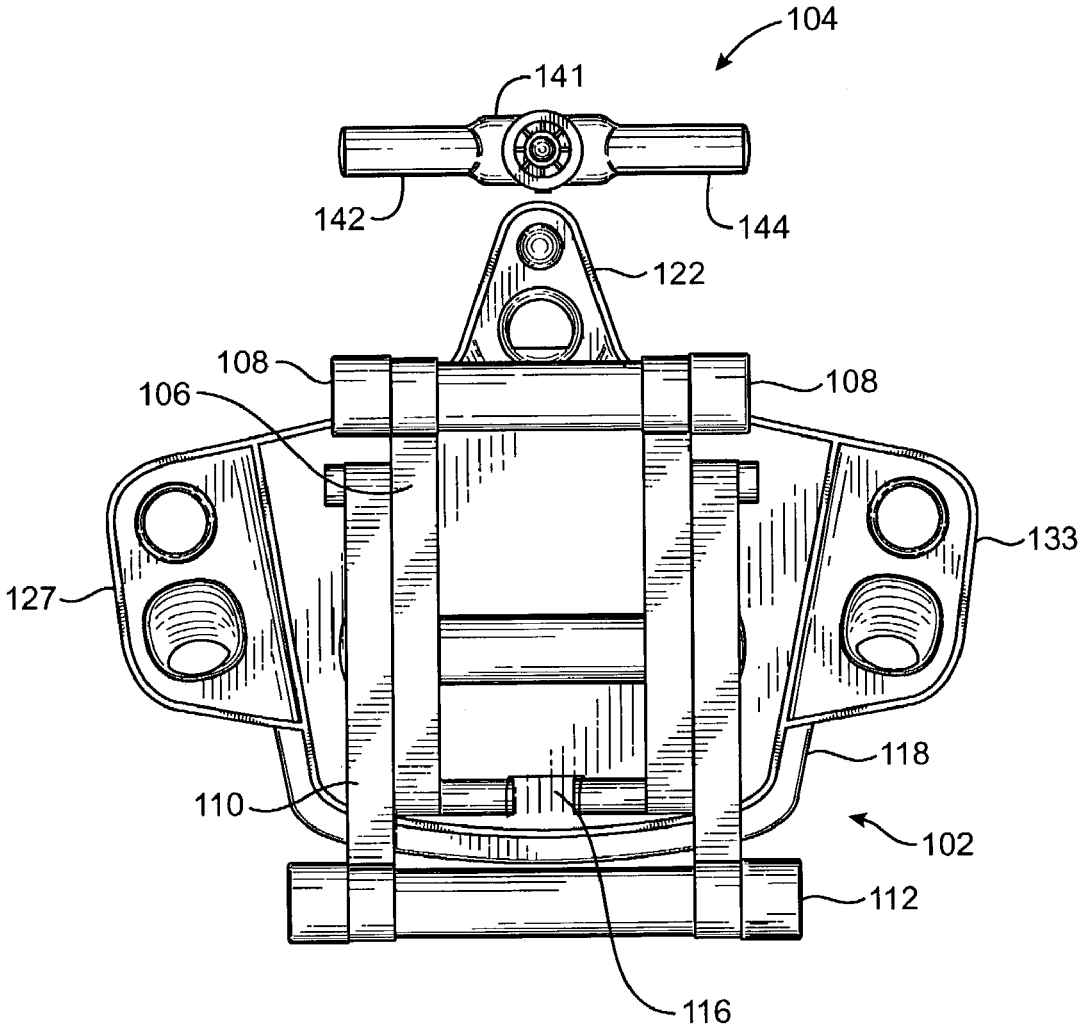
FIG. 6 is an exploded rear plan view of the exercise device.

Disclosed is an exercise device that is compact, lightweight, portable, relatively inexpensive, and fairly versatile. The exercise device as shown in FIGS. 1 through 6 includes a base portion 102, and a resistance member 104. The base portion is spaced from floor level by a first support 106, with a first horizontal stabilizer 108 and a second support 110 with a second horizontal stabilizer 112. The supports are extendable from the bottom of the base portion 102 and the supports pivot along a pivot bar 114 with a scissors action. The supports are foldable onto the bottom side of the base portion 102 so that the base portion 102 may be stored in a compact space, such as underneath a bed or in a closet. A hook 116 is located on the bottom side of base portion 102 so as to secure the supports when in an extended position.

Figure 16:
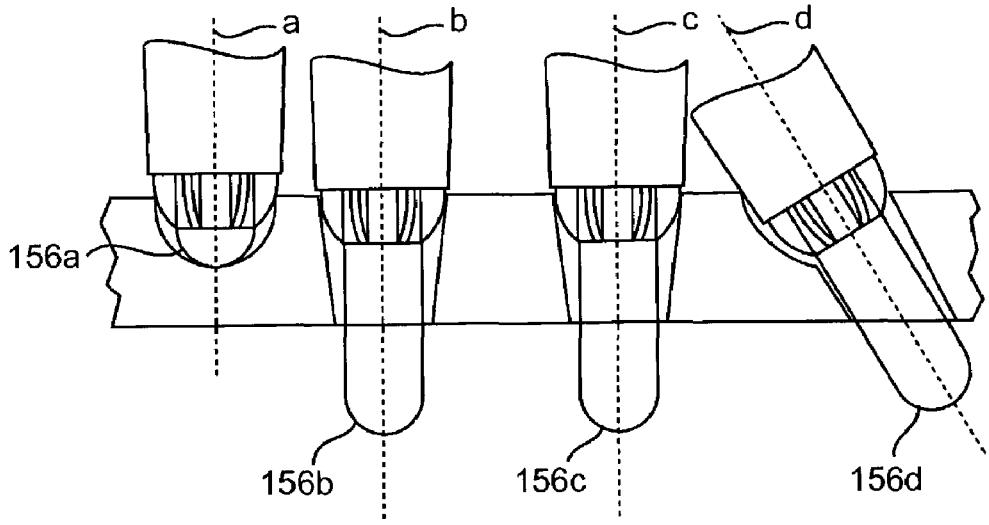
FIG. 16 is a cross-sectional view taken from 16—16 of FIG. 15.

The base portion 102 includes a seat portion 118 that is adapted to accommodate a user to set upon the seat portion 118. A pad 120 is located on the top of the seat portion for the comfort of the user. The seat portion 118 includes a center extension 122 which extends from the center of the front portion of the seat portion 118. The center extension 122 is adapted to extend between the thighs of a user sitting on the seat portion 118. The center extension 122 includes a stationary indentation 124, which is not a through hole, but as shown in FIG. 16, is an indentation in the center extension 124. Adjacent to the stationary indentation 124 is a center aperture or receptacle 126. As shown in FIG. 16 the center aperture is conical in shape with the larger diameter being at the top surface of the center extension so as to easily accept the handle 104, which will be further described below. The conical shape of the aperture allows the handle to pivot in the center aperture 126 so as to allow the handle to be positioned according to the motion of the exercise of the user and according to the comfort of the particular user.

The base portion 102 further includes a right side extension 127, the right hand side extension includes a right hand side conical aperture 128 and positioned directly behind the right hand side conical aperture 128 is a right hand side guide and aperture 131. The right hand side conical aperture 128 is similar in size and shape to the center conical aperture 126. The axii of the conical apertures 126 and 128 are generally perpendicular with the ground or floor that the base portion 102 sits on. However, the right hand side guide and aperture 131, as shown in FIG. 16 has an extended guide portion to guide the end of the resistance member 104 into the aperture and to orient the resistance member 104 at the proper angle which is not parallel with the other axii of the conical apertures nor perpendicular with the ground or floor. As this will be further described below, this different angled orientation of the resistance member 104 into the base portion 102 allows the user to perform exercises with a twisting motion to the sides.

The base portion 102 further includes a left hand side extension 133 which is essential a mirror image of the right hand side extension 127. The left hand side extension 133 includes a left hand side conical aperture 132 and located directly behind the left hand side conical aperture 132 is a left hand side guide and aperture 134.

The resistance member 104 includes handle portion 141. The handle portion 141 includes a first grip 142 and a second grip 144. The first and second grips are adapted to allow the user to grip the resistance member with either an overhand, underhand or combination of the two grip with both hands. The resistance member 104 includes a midsection 146 which houses resistance means, as will be further described below, with at least one portion of the midsection 146 being compressable or extendable. The upper portion of the midsection 146 includes an upper housing for the midsection 148 and adjacent to the upper housing 148 is a lower flexible housing for the midsection 150. The resistance member 104 further includes at a distal end a seating portion 152, which is adapted to fit into stationary indentation 124, conical apertures 128 and 132, and guide and apertures 131 and 134. The resistance member 104 further includes a stationary extension 154 and an extendable portion 156. As will be further described below, the extendable portion 156 extends from the stationary extension 154 when resistance is placed on the handle 141 and the midsection 146 is placed in compression.

The resistance member 104 further includes a plurality of height adjustment openings 158 so that the handle portion 141 may be adjusted to the appropriate height according to the particular user. Once the height is adjusted appropriately, a removable pin 160 is placed through the handle portion 141 and through a tube member extending from the midsection 146. The resistance member 104, as will be further described below, further includes a resistance adjustment collar 163, which allows the resistance of the resistance member to be adjusted according to the user's preference.

As shown in FIG. 16, the seating portion 152 of the resistance member 104 is adapted to be positioned in the stationary indentation 124, the conical apertures 128 and 132, and the guide and apertures 131 and 134 one at a time. When the resistance member is located in the stationary indentation 124, and the apertures 128 and 132, the resistance member is generally perpendicular to the ground or floor level, however, the resistance member may be adjusted according to the user's needs, since the apertures in the indentation are conical in shape. When the resistance member is positioned in the guide and apertures 131 and 134, the resistance member is in an angled position that is generally non-perpendicular with the floor or ground level.

The resistance mechanism, in one embodiment, uses springs to provide resistance. According to the first embodiment, the resistance is variable which, as will be further described below, includes at least two springs that are concentric in design to be engaged through a lock and key mechanism. A plate that has empty slots is secured on top of each concentric spring, thereby providing a surface for the spring to be engaged by the key.

The key is secured around a shaft that can turn by turning a dial. When the dial is turned, the key is either placed above a slot in the plate attached to a specific spring, in which case it will not engage, or above a solid portion of the plate, in which case it will engage. When the key is turned, none of the springs can be engaged, or one may be engaged, or two may be engaged.

A third spring is placed in a permanently engaged position vertically on the top of the concentric springs. When the lower two concentric springs are not engaged, the upper spring is the only spring providing resistance. When the lower concentric springs are engaged, total resistance is increased. The design therefor provides at least three levels of resistance, depending upon the engagement of one, two or all three springs.

Figure 7:
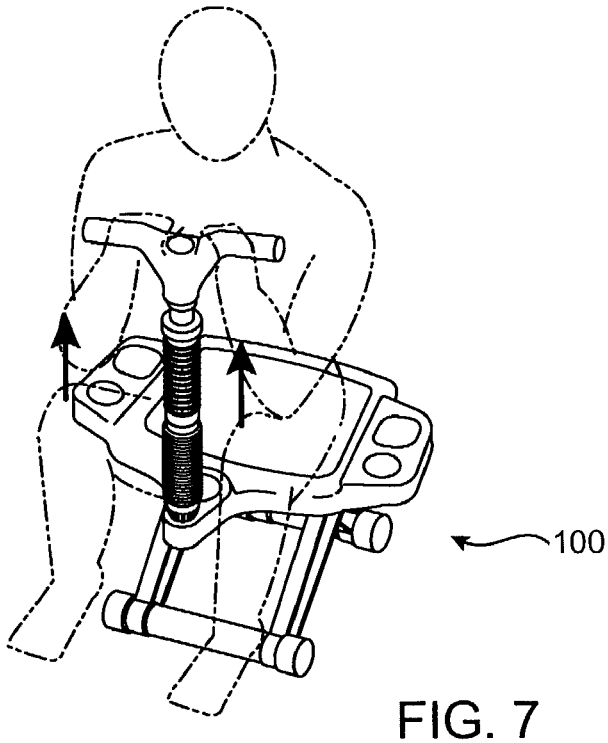
FIG. 7 is an illustration of a first exercise that may be conducted in the exercise device.

In FIG. 7 the resistance member 104 is located in stationary indentation 124. Stationary indentation 124 is not a through aperture, therefore, the extendable portion 156 does not extend through the stationary indentation 124 when resistance or force is provided onto the handle 141 by the user. Therefore, this position provides the user an opportunity to keep the resistance member 104 in a static state which allows the user to perform leg-lifts or simulate a bicycle motion while sitting on the base member 102.

Figure 8:
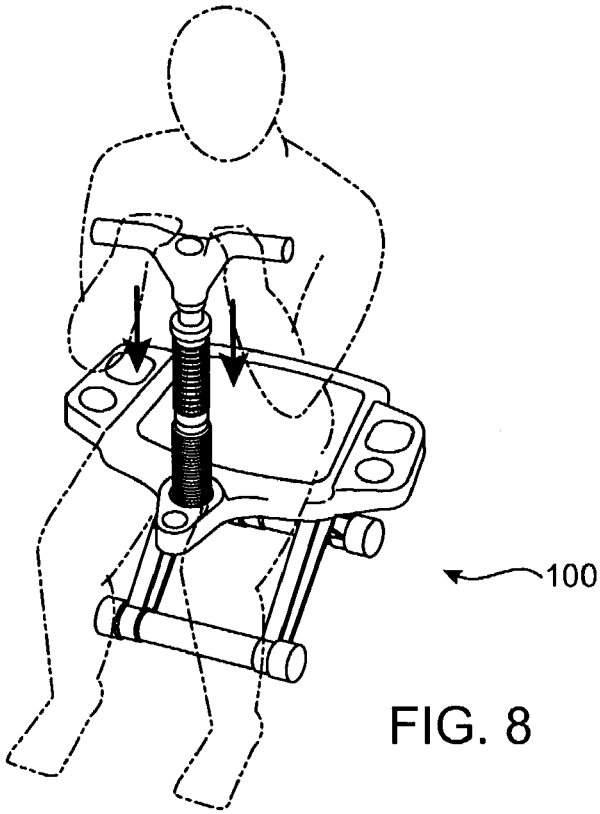
FIG. 8 is a second exercise that may be conducted on the exercise device.

In FIG. 8, the resistance member 104 is located in center conical aperture 126. Therefore, when resistance or force is exerted onto the handle 141, the extendable portion 156 extends through the center conical aperture 126 proportional to the amount of force applied by the user and the amount of resistance set in the resistance member 104. This allows the user to perform simulated stomach crunches while sitting in an upright position and while efficiently isolating the stomach muscles.

Figure 9:
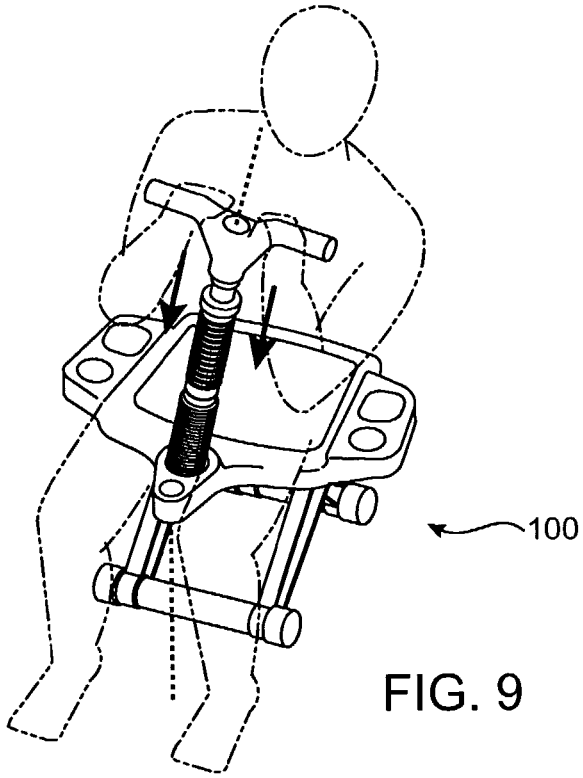
FIG. 9 is a third exercise that may be conducted on the exercise device.
Figure 10:
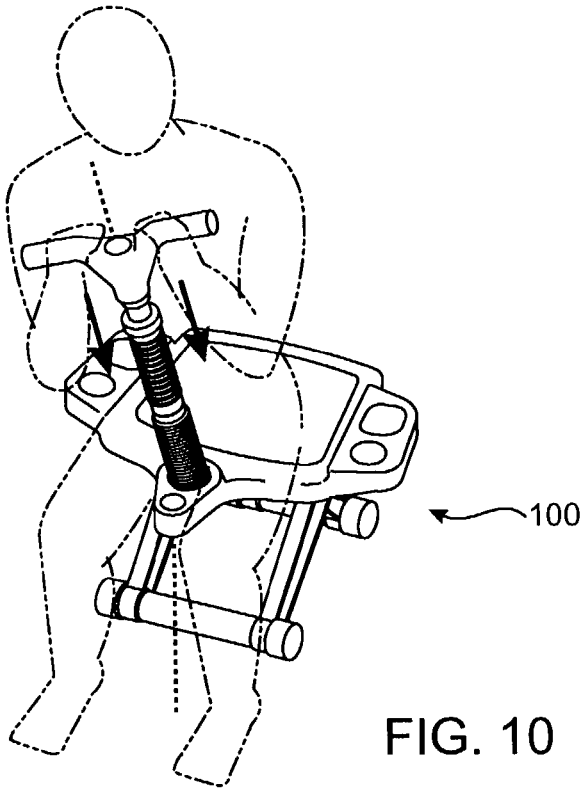
FIG. 10 is a fourth exercise that may be conducted on the exercise device.

FIG. 9 illustrates a similar exercise as FIG. 8, but the user has rotated the resistance member 104 to his left side. Likewise, as shown in FIG. 10 the exercise is similar as shown in FIGS. 8 and 9, except that the user is leaning to his right hand side.

Figure 11:
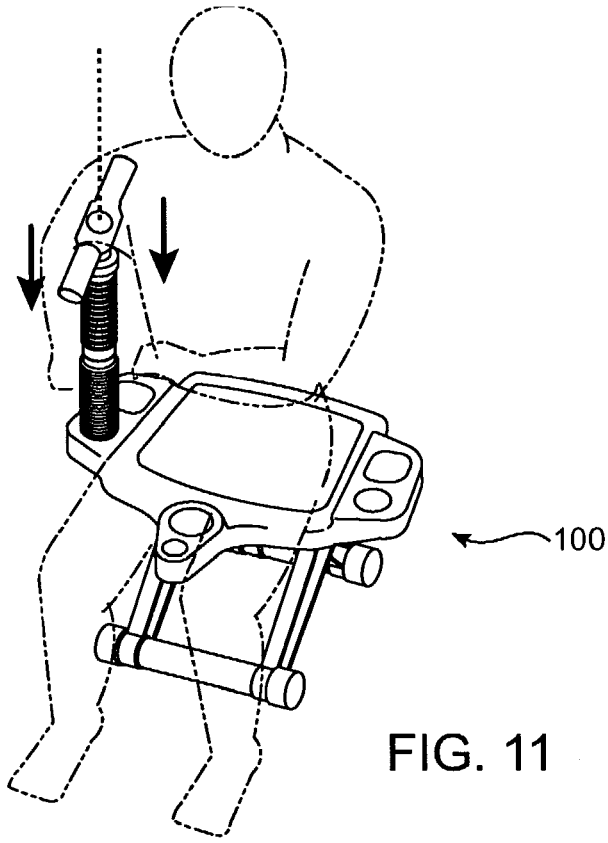
FIG. 11 is a fifth exercise that may be conducted on the exercise device.
Figure 12:
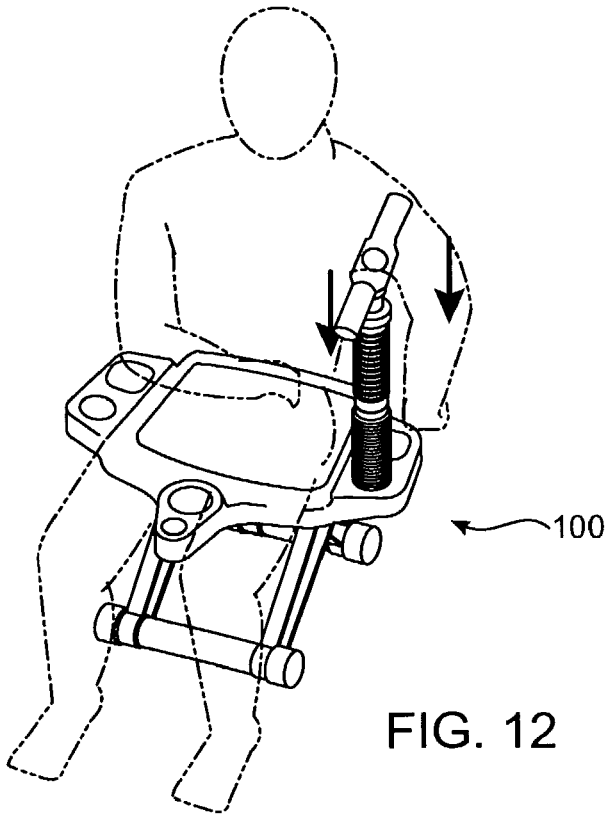
FIG. 12 is a sixth exercise that may be conducted on the exercise device.

FIG. 11 illustrates the resistance member 104 located in the right hand side conical aperture 128. In this exercise, the handle portion 141 is placed underneath the user's right underarm and the user compresses the resistance member by leaning to his right hand side. Likewise, as shown in FIG. 12, the exercise is similar to the one shown in FIG. 1, except that the resistance member 104 is shown in the left hand side conical aperture 132.

Figure 13:
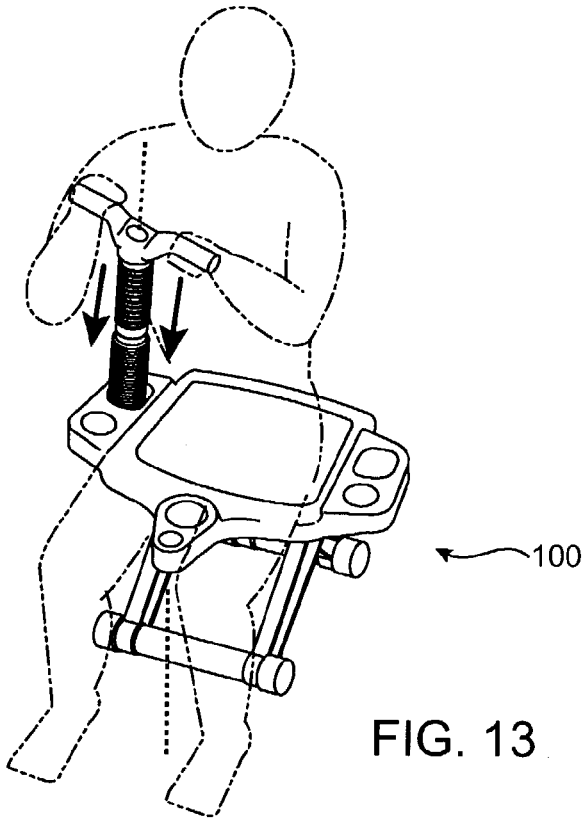
FIG. 13 is a seventh exercise that may be conducted on the exercise device.
Figure 14:
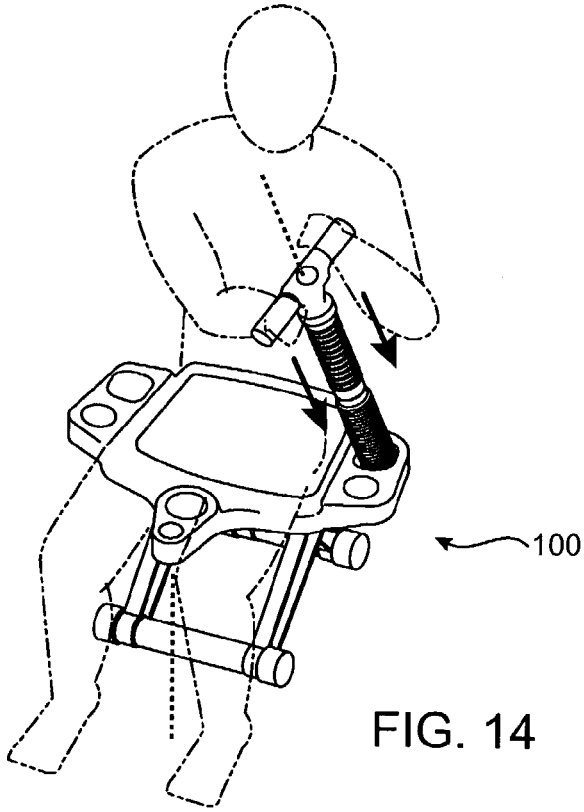
FIG. 14 is an eighth exercise that may be conducted on the exercise device.
Figure 15:
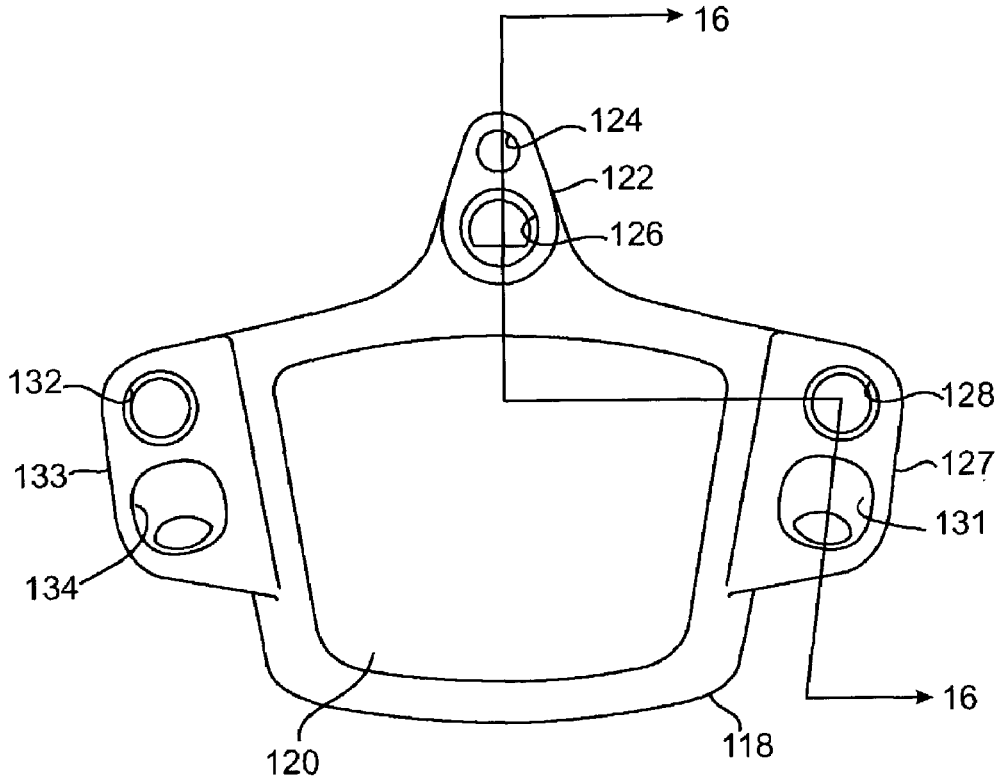
FIG. 15 is a top plan view of the base portion of the exercise device.

FIG. 13 illustrates the resistance member 104 in the right hand side guide and aperture 131 and as shown in FIG. 16, this orientates the resistance member 104 at a forward angle position so that the user may compress the resistance member 104 by performing a right side twisting motion. Likewise, as shown in FIG. 14, the resistance member 104 is located in the left hand side guide and aperture 134 and this allows the user to compress the resistance member 104 by rotating to the left side.

Figure 17:
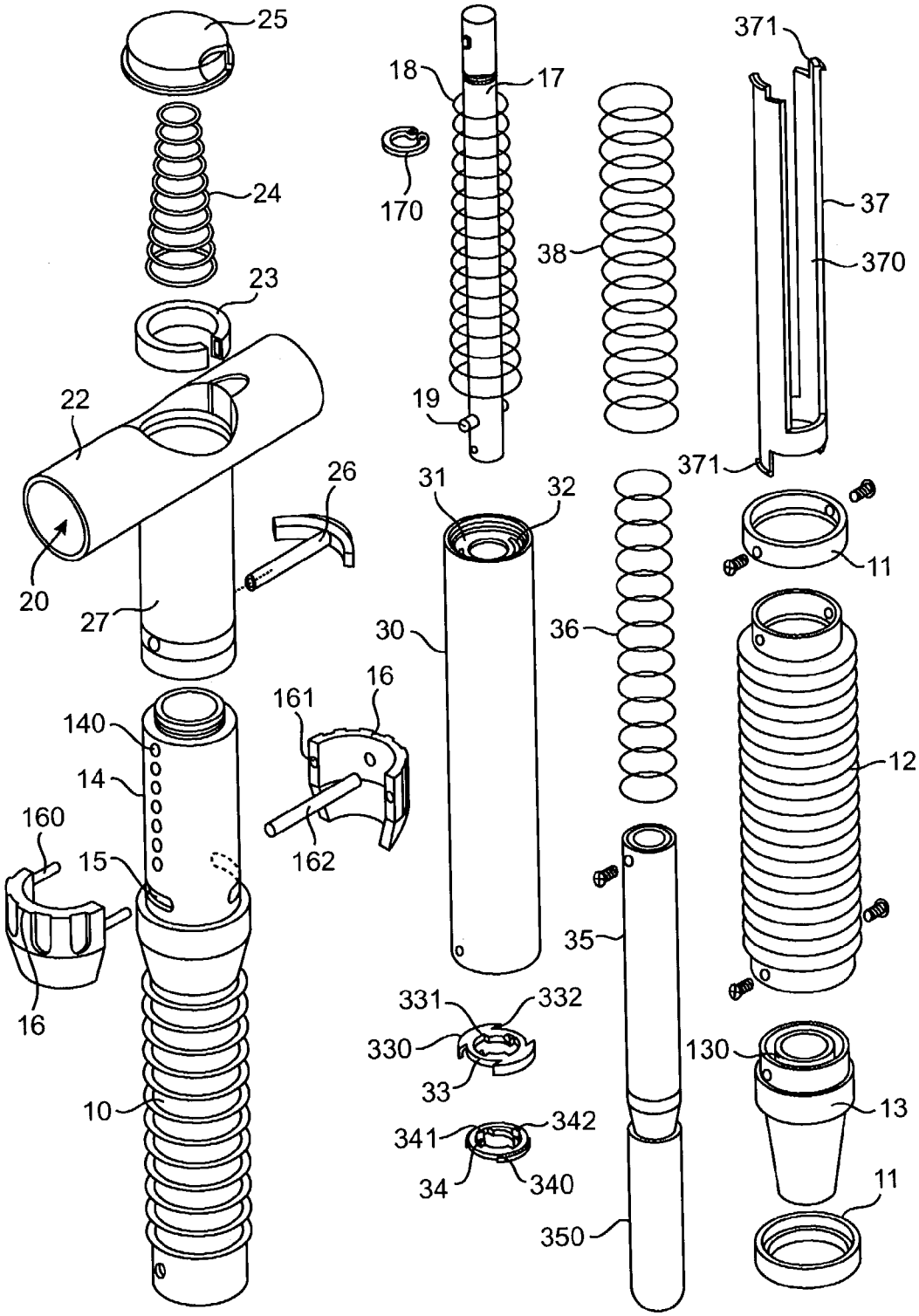
FIG. 17 is an exploded perspective view of the resistance member in accordance with one embodiment of the present disclosure.
Figure 18:
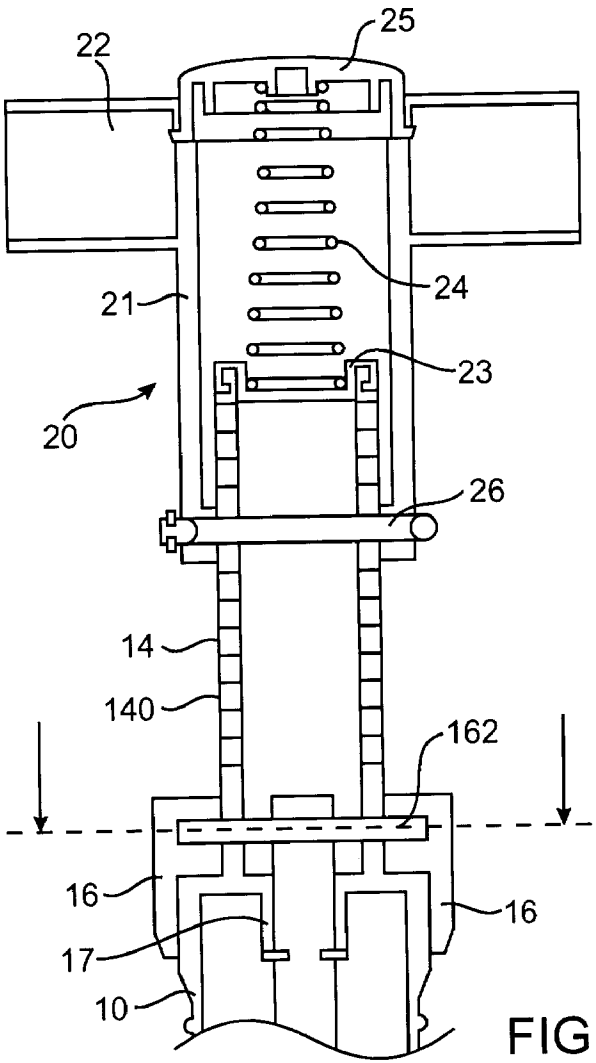
FIG. 18 is a plan cross-sectional assembly view of the resistance member.
Figure 19:
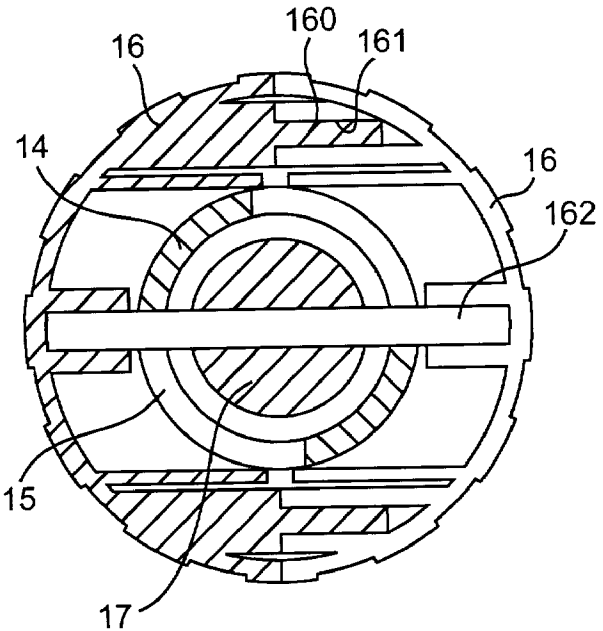
FIG. 19 is a cross-sectional view of the body exercising device taken from line 19—19 in FIG. 18.
Figure 20:
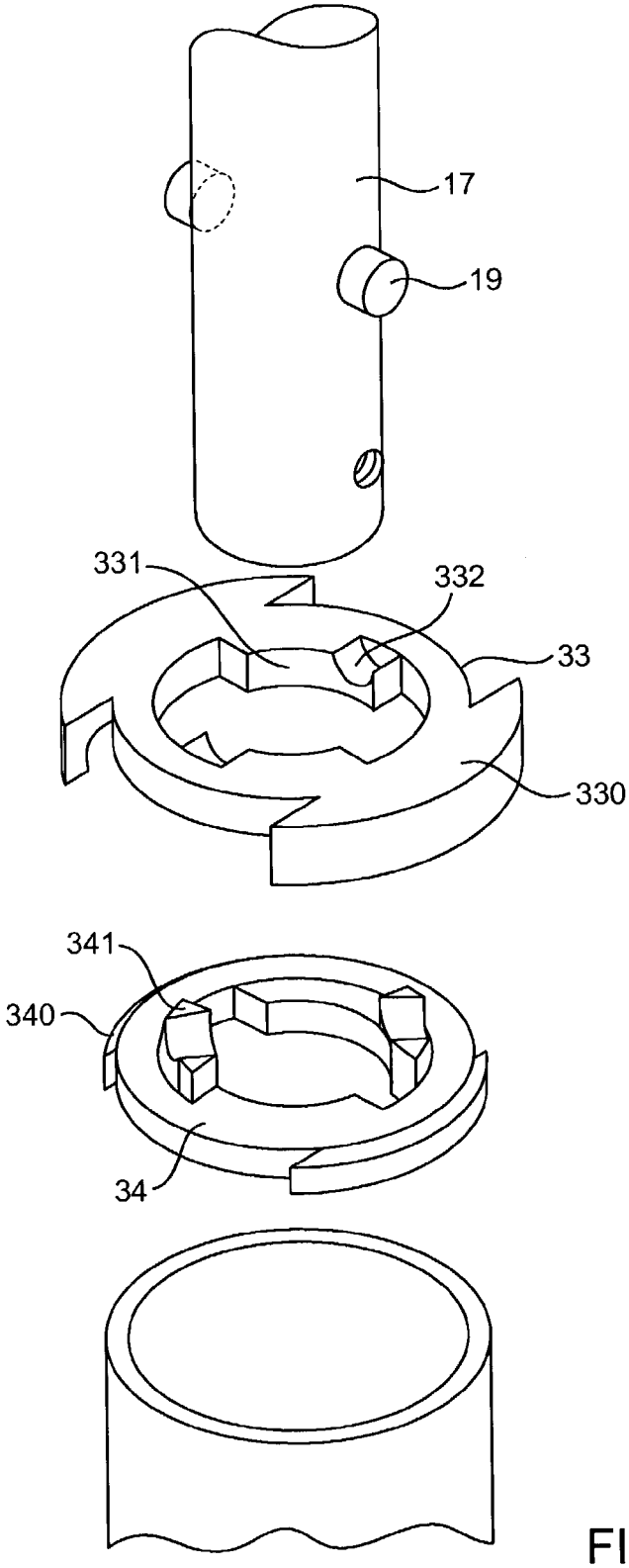
FIG. 20 is an exploded perspective view of a drive structure of the resistance member.
Figure 22:
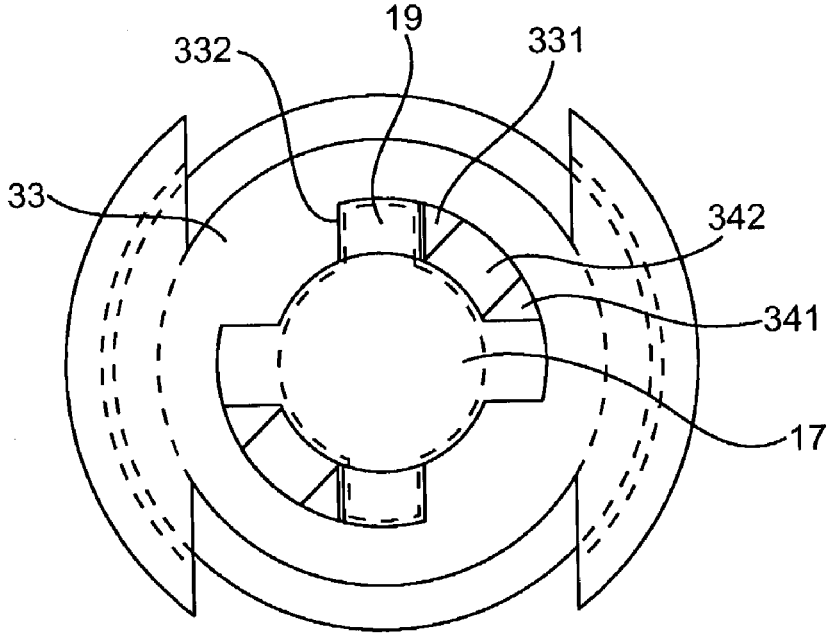
FIG. 22 is a cross-sectional assembly view of the resistance member.
Figure 21:
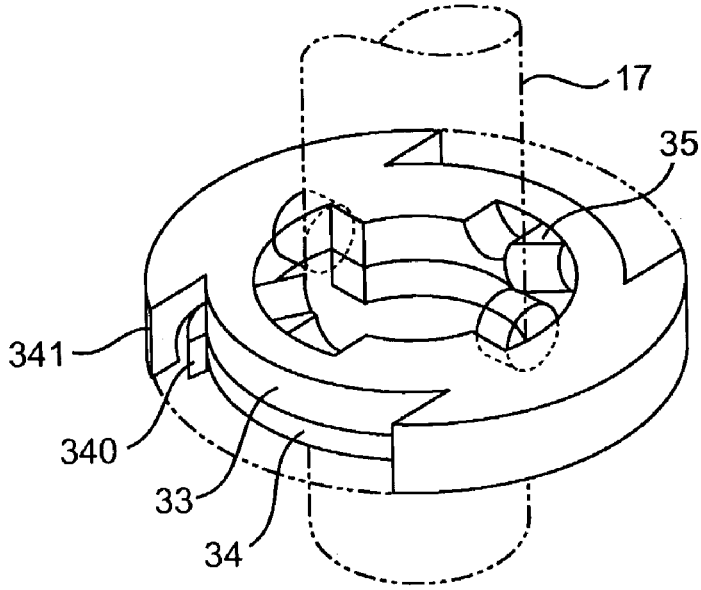
FIG. 21 is a perspective assembly view of the drive structure of the resistance member.
Figure 23:
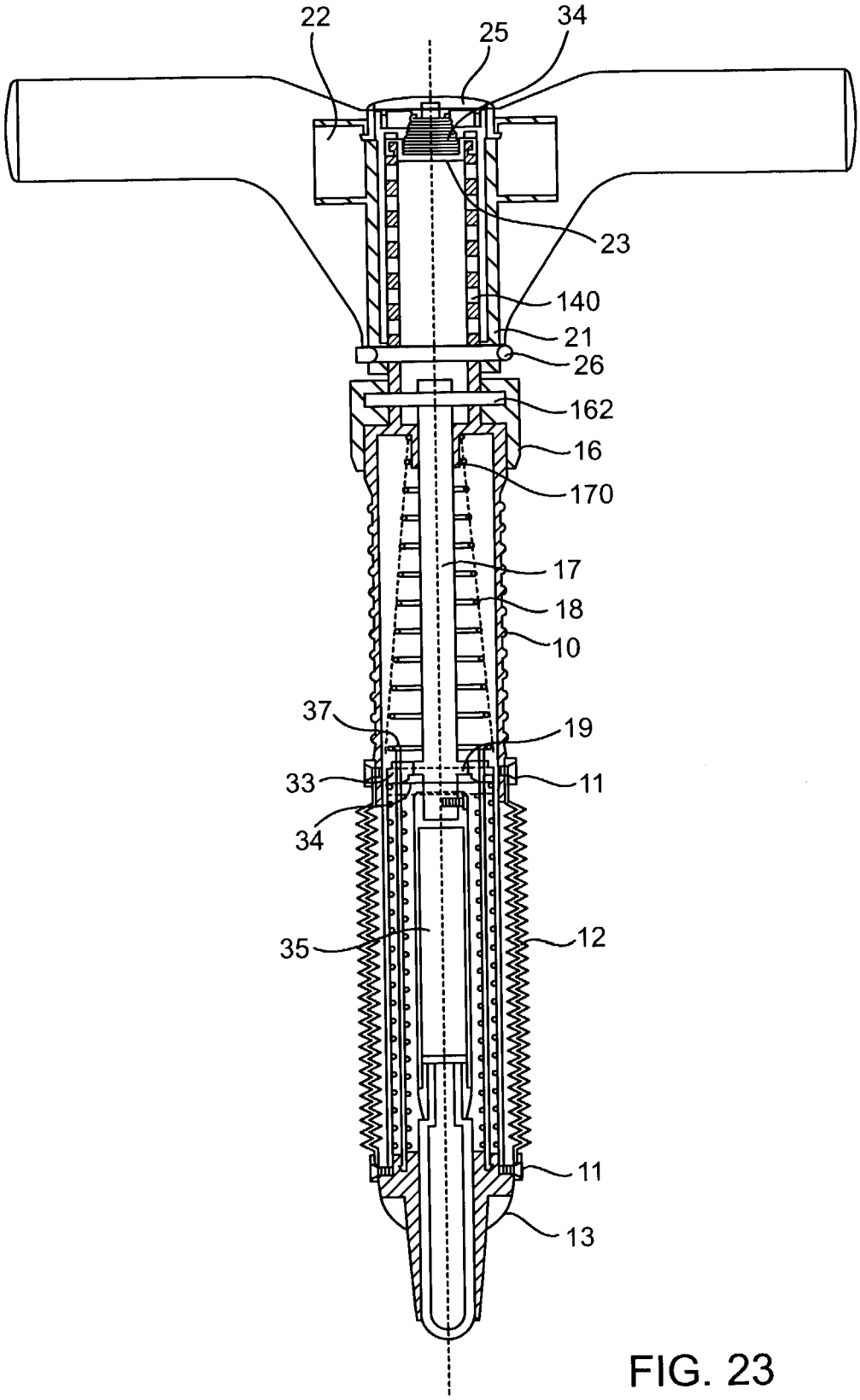
FIG. 23 is a plan cross-sectional assembly view of the resistance member at rest.
Figure 24:
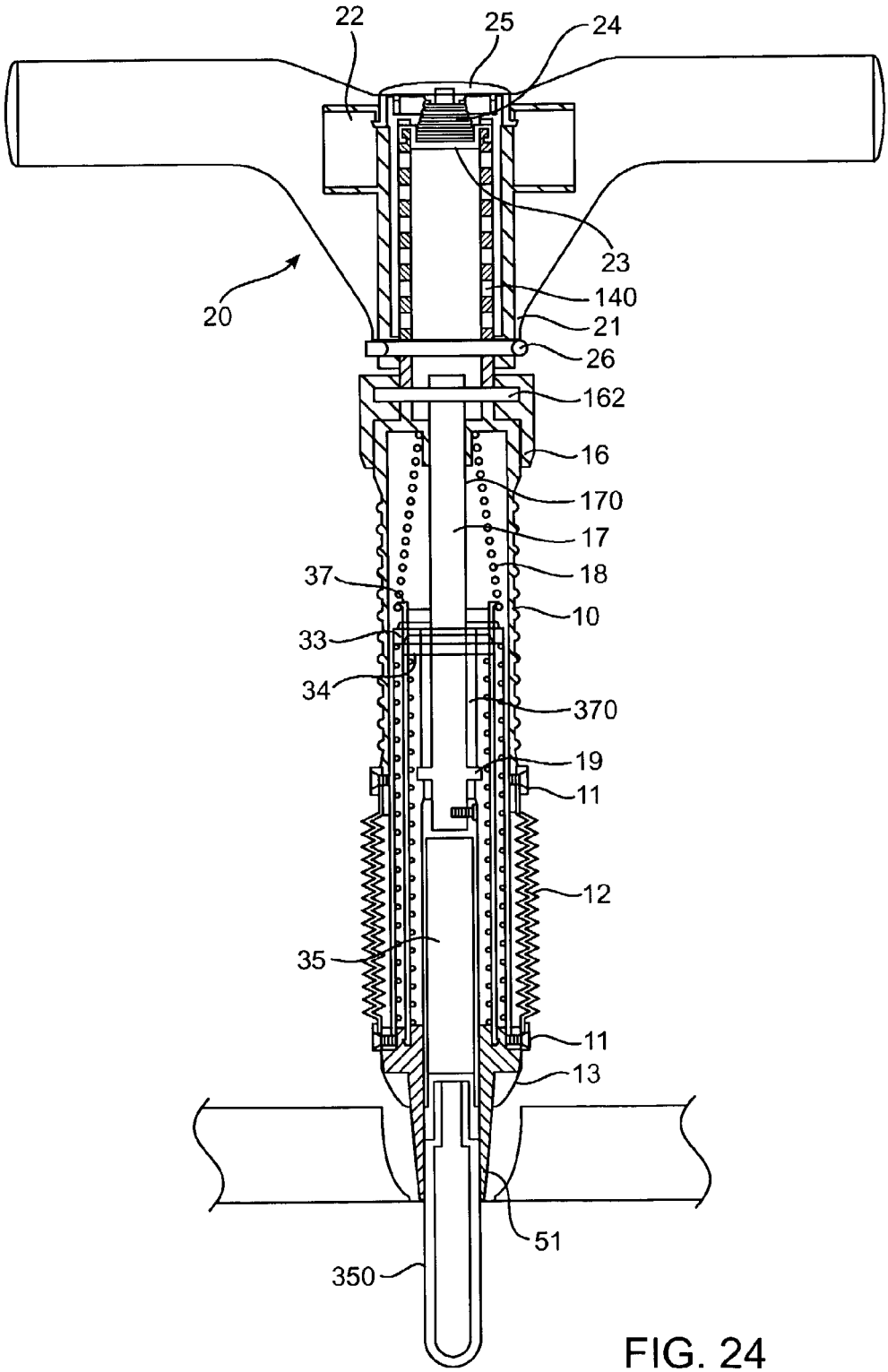
FIG. 24 is a plan cross-sectional assembly view of the resistance member in compression.

Referring to the drawings and initially to FIG. 17, a body exercising device in accordance with a preferred embodiment of the present invention comprises a sleeve 10 having a top end provided with a handle mounting structure 20. A drive structure is mounted in the sleeve 10. The drive structure may use a guide rod 17 which has a first spring 18 and connects an inner tube 35 which has a second spring 36. A middle tube 37 is mounted on the inner tube 35 and has a third spring 38, and an outer tube 30 is mounted on the middle 37. The guide rod 37 may drive a first race 33 and a second race 34 which may slide on the middle tube 37 respectively or simultaneously, so that the first race 33 and the second race 34 may co-operate with the first spring 18 to press the second spring 36 and the third spring respectively or simultaneously, thereby changing the load of the body exercising device.

The top end of the sleeve 10 is protruded with an upright tube 14 formed with a plurality of adjusting holes 140. The handle mounting structure 20 is mounted on the upright tube 14, and includes a hollow handle mounting tube 21 mounted on the upright tube 14. The top end of the handle mounting tube 21 is formed with a transverse tube 22 for mounting a handle. The connection of the handle mounting tube 21 and the transverse tube 22 has a through hole, so that a support seat 23 may be snapped on the top end of the upright tube 14 through the handle mounting tube 21. A top cover 25 is mounted on the top end of the handle mounting tube 21, and a compression spring 24 is mounted between the support seat 23 and the top cover 25. A positioning rod 26 is extended through the handle mounting tube 21, and is inserted into one of the adjusting holes 140 of the upright tube 14, so that the handle mounting structure 20 may be used to adjust the height of the handle.

A retractable sleeve 12 is secured on the bottom end of the sleeve 10 by a clamping ring 11. An insertion sleeve 13 is secured on the bottom end of the retractable sleeve 12, and may be inserted into the insertion holes 51 and 52 of a seat cushion. The top face of the insertion sleeve 13 is formed with at least one locking hole 130 for snapping the middle tube 37. The sleeve 10 has a mediate section having an outer wall formed with two opposite rotation slots 15. The drive structure is mounted on the two opposite rotation slots 15.

The drive structure includes two opposite semi-annular rotation blocks 16 respectively mounted on the sleeve 10. A first one of the two opposite semi-annular rotation blocks 16 is formed with two insertion holes 161, and a second one of the two opposite semi-annular rotation blocks 16 is provided with two insertion rods 160 each inserted into each of the two insertion holes 161, so that the two opposite semi-annular rotation blocks 16 may be combined together. The first one of the two opposite semi-annular rotation blocks 16 is provided with a passage rod 162 that is extended through the two opposite rotation slots 15 of the sleeve 10, and is extended through the top end of the guide rod 17. A snap ring 170 is snapped on the top end of the guide rod 17. The first spring 18 is mounted on the guide rod 17 and is located under the snap ring 170. The bottom end of the guide rod 17 is provided with a protruding drive shaft 19 for driving the first race 33 and the second race 34.

The guide rod 17 is extended through the outer tube 30 that is mounted in the sleeve 10. The top end of the outer tube 30 is urged on the bottom end of the first spring 18, and is formed with a push plate 31 formed with at least one locking hole 32 for snapping the middle tube 37.

The first race 33 is mounted in the outer tube 30, and has an inner wall provided with two protruding blocks 331 each formed with a locking recess 332 for insertion of the drive shaft 19 of the guide rod 17. Similarly, the second race 34 is mounted in the outer tube 30, and has an inner wall provided with two protruding blocks 341 each formed with a locking recess 342 for insertion of the drive shaft 19 of the guide rod 17. In addition, each of the two protruding blocks 341 of the second race 34 is protruded upward to flush with each of the two protruding blocks 331 of the first race 33. Further, the first race 33 has an outer wall provided with a guide block 330 that may slide on the middle tube 37, and the second race 34 has an outer wall provided with a guide block 340 that may slide on the middle tube 37.

The top end of the inner tube 35 is secured on the bottom end of the guide rod 17, and a slide head 250 is secured on the bottom end of the inner tube 35 and is inserted into the insertion sleeve 13. The second spring 36 is mounted on the inner tube 35, and is urged between the second race 34 and the insertion sleeve 13, so that the second race 34 may be used to compress the second spring 36. The middle tube 37 is mounted between the second spring 36 of the inner tube 35 and the outer tube 30, and has an outer wall provided with two opposite guide grooves 370 for guiding movement of the guide block 330 of the first race 33 and the guide block 340 of the second race 34. The middle tube 37 has a top end provided with at least one snap block 317 snapped into the locking hole 32 of the push plate 31 of the outer tube 30, and has a bottom end provided with at least one snap block 371 snapped into the locking hole 130 of the insertion sleeve 13. The third spring 38 is mounted on the middle tube 37, and is urged between the first race 33 and the insertion sleeve 13, so that the first race 33 may be used to compress the third spring 38.

By the above-mentioned design, the snap ring 170 of the guide rod 17 may be used to compress the first spring 18. In addition, the rotation blocks 16 of the drive structure may be rotated to rotate the drive shaft 19 of the guide rod 17, so that the drive shaft 19 of the guide rod 17 may be inserted into the first race 33 or the second race 34, thereby increasing the pushing and supporting force of the second spring 36 and the third spring 38, and thereby changing the exercising load, so as to achieve the requirements of different users. Thus, the body exercising device of the present disclosure may change the exercising load, and may be operated easily and conveniently.

When the user needs a lighter load, the drive structure is not operated. At this time, the drive shaft 19 of the guide rod 17 directly passes through the center of the first race 33 and the second race 34, without pressing the first race 33 and the second race 34. Thus, when the handle is pressed downward, the snap ring 170 of the guide rod 17 may be pressed by the sleeve 10 to compress the first spring 18, so that the sleeve 10 is retracted relative to the outer tube 30, thereby performing an exercising action with a lighter load.

When the user needs to increase the exercising load, the rotation blocks 16 of the drive structure may be rotated to rotate the passage rod 162 which rotates the guide rod 17, so as to rotate the drive shaft 19 of the guide rod 17, so that the drive shaft 19 of the guide rod 17 may be inserted into the locking recess 342 of the second race 34. Thus, when the handle is pressed downward, the snap ring 170 of the guide rod 16 may be pressed by the sleeve 10 to compress the first spring 18, while the second race 34 may be used to compress the second spring 36, thereby changing the exercising load.

When the user needs to further increase the exercising load, the rotation blocks 16 of the drive structure may be further rotated to rotate the passage rod 162 which rotates the guide rod 17, so as to rotate the drive shaft 19 of the guide rod 17, so that the drive shaft 19 of the guide rod 17 may be inserted into the locking recess 332 of the first race 33. In addition, the first race 33 is located above the second race 34. Thus, when the handle is pressed downward, the snap ring 170 of the guide rod 17 may be pressed by the sleeve 10 to compress the first spring 18, while the second race 34 may be used to compress-the second spring 36, and the first race 33 may be used to compress the third spring 38. Thus, the three sets of springs may be compressed simultaneously, thereby further changing the exercising load, so as to achieve the requirements of different users.

The positioning rod 36 of the handle mounting structure 20 is extended through the handle mounting tube 21, and may be inserted into one of the adjusting holes 140 of the upright tube 14, so as to adjust the relative distance between the handle mounting tube 21 and the upright tube 14, so that the handle mounting structure 20 may be used to adjust the height of the handle, so as to fit requirements of the users of different statures.

Therefore, disclosed is an exercise device system with a removable resistance member that may be positioned in a variety of locations to allow the user to accomplish a variety of physical exercises, and to move the resistance device around the base while remaining seated. The resistance member is designed to be positioned in apertures or receptacles located around the periphery of a seat located on the base member. The resistance member may be located at different angles to provide a variety of exercises for the user. The resistance mechanism may take a variety of forms, including springs, rubber, hydraulics or pneumatics, or any other means to provide a resistance to the user during the physical exercises. The base member may include adjustable supports so that the device may be located at varying distances from the floor level, according the size of the user. The extension member of the resistance member extends into the receptacles to prevent the resistance member from falling out of the receptacle while at rest or from disengaging from the receptacle while in use. As shown in the FIGS, the handle include a notch so that the handle is adapted to be placed under the arm or the underarm of the user for the side movement exercises.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A body exercising device comprising:

a sleeve having a top end protruded with an upright tube, the upright tube provided with a handle mounting structure for mounting a handle, a retractable sleeve secured on the bottom end of the sleeve, an insertion sleeve secured on the bottom end of the retractable sleeve and inserted into the insertion holes of a seat cushion, the sleeve having a mediate section having an outer wall formed with two opposite rotation slots for mounting a drive structure;

the drive structure including two opposite rotation blocks respectively mounted on the sleeve, a passage rod mounted between the two opposite rotation blocks and extended through the two opposite rotation slots of the sleeve, a guide rod having a top end mounted on the passage rod, a first spring mounted on the guide rod, the guide rod having a bottom end provided with a protruding drive shaft for driving a first race and a second race;

an outer tube mounted in the sleeve for passage of the guide rod, the top end of the outer tube urged on the bottom end of the first spring, the first race mounted in the outer tube and having an inner wall provided with two protruding blocks for pressing of the drive shaft of the guide rod, the second race mounted in the outer tube and having an inner wall provided with two protruding blocks for pressing of the drive shaft of the guide rod, the first race having an outer wall provided with a guide block that may slide on a middle tube, and the second race having an outer wall provided with a guide block that may slide on the middle tube;

an inner tube having a top end secured on the bottom end of the guide rod, a second spring mounted on the inner tube and urged between the second race and the insertion sleeve;

the middle tube mounted between the second spring of the inner tube and the outer tube and having an outer wall provided with two opposite guide grooves for guiding movement of the guide block of the first race and the guide block of the second race, a third spring mounted on the middle tube and urged between the first race and the insertion sleeve;

wherein, the sleeve may be used to compress the first spring, while the rotation blocks of the drive structure may be rotated to rotate the drive shaft of the guide rod, so that the drive shaft of the guide rod may be inserted into the first race or the second race, thereby increasing the pushing and supporting force of the second spring and the third spring, and thereby changing the exercising load, so as to achieve the requirements of different users.

2. The body exercising device in accordance with claim 1, wherein the upright tube of the sleeve is formed with a plurality of adjusting holes, the handle mounting structure includes a hollow handle mounting tube mounted on the upright tube, and a positioning rod is extended through the handle mounting tube, and is inserted into one of the adjusting holes of the upright tube, so that the handle mounting structure may be used to adjust the height of the handle.

3. The body exercising device in accordance with claim 2, wherein the top end of the handle mounting tube is formed with a transverse tube for mounting the handle, the connection of the handle mounting tube and the transverse tube has a through hole, so that a support seat may be snapped on the top end of the upright tube through the handle mounting tube, a cop cover is mounted on the top end of the handle mounting tube, and a compression spring is mounted between the support seat and the top cover.

4. The body exercising device in accordance with claim 1, wherein the retractable sleeve is secured on the bottom end of the sleeve by a clamping ring.

5. The body exercising device in accordance with claim 1, herein the top face of the insertion sleeve is formed with at least one locking hole, the top face of the outer tube is formed with at least one locking hole, and the middle tube has a top end provided with at least one snap block snapped into the locking hole of the outer tube, and has a bottom end provided with at least one snap block snapped into the locking hole of the insertion sleeve.

6. The body exercising device in accordance with claim 1, wherein a first one of the two opposite rotation blocks is formed with two insertion holes, and a second one of the two opposite rotation blocks is provided with two insertion rods each inserted into each of the two insertion holes, so that the two opposite rotation blocks may be combined together.

7. The body exercising device in accordance with claim 1, wherein each of the two protruding blocks of the first race is formed with a locking recess for insertion of the drive shaft of the guide rod, and each of the two protruding blocks of the second race is formed with a locking recess for insertion of the drive shaft of the guide rod.

8. The body exercising device in accordance with claim 1, further comprising a slide head secured on the bottom end of the inner tube and inserted into the insertion sleeve.

* * * * *